United States Patent [19]

Massey

[11] 3,981,082

[45] Sept. 21, 1976

[54] APPARATUS AND METHOD FOR MONITORING THE MOISTURE GRADIENT IN A MOVING WEB

[75] Inventor: William A. Massey, Mount Holly, N.J.

[73] Assignee: Molins Machine Company, Inc., Camden, N.J.

[22] Filed: May 30, 1975

[21] Appl. No.: 582,569

[52] U.S. Cl. ..... 34/1; 324/58.5 A

[51] Int. Cl.[2] ..... F26B 3/34

[58] Field of Search ..... 34/1, 48; 324/58.5 R, 324/58.5 A

[56] References Cited

UNITED STATES PATENTS

| | | | |
|---|---|---|---|
| 3,034,046 | 5/1962 | Sasaki | 324/58.5 A |
| 3,340,125 | 9/1967 | Drenning et al. | 34/1 |
| 3,399,460 | 9/1968 | Russell | 34/1 |
| 3,404,462 | 10/1968 | Hanson et al. | 34/1 |
| 3,470,343 | 9/1969 | Bilbrough | 34/1 |
| 3,811,087 | 5/1974 | Schmelzer | 324/58.5 A |
| 3,848,342 | 11/1974 | Bartles et al. | 34/48 |

*Primary Examiner*—John J. Camby
*Assistant Examiner*—Larry I. Schwartz
*Attorney, Agent, or Firm*—Seidel, Gonda & Goldhammer

[57] ABSTRACT

Apparatus and method are disclosed for detecting the moisture gradient in a moving web. A radio frequency signal is applied to a transmitting means which transmits an electromagnetic field through the web being sensed. The moisture gradient of the web is monitored by sensing a control signal which is indicative of fluctuations in the strength of the transmitted electromagnetic field owing to the absorption of energy by moisture on the web moved through the field.

15 Claims, 5 Drawing Figures

APPARATUS AND METHOD FOR MONITORING THE MOISTURE GRADIENT IN A MOVING WEB

The present invention is directed towards an apparatus and method for detecting the moisture gradient in a moving web. More particularly, the present invention is directed towards an apparatus and method for detecting the moisture gradient in a moving web by sensing the power loss in a radio frequency signal transmitted through the web.

In accordance with the principles of the present invention, a radio frequency signal is applied to a pair of spaced transmitting elements which create an electromagnetic field through part of which the material to be sensed is drawn. As the material moves through the electromagnetic field, some of the electromagnetic energy is absorbed by moisture on the material. As a result of this loss of energy, a radio frequency amplitude modulated signal appears across the spaced transmitting elements. The envelope of this amplitude modulated signal is representative of the fluctuations in the energy losses in the transmitted signal absorbed by the moisture on the material being sensed. Thus, by detecting the fluctuations in the envelope of the amplitude modulated signal appearing across the transmitting elements, the moisture gradient in the moving material can be monitored.

In the preferred application of the present invention, the wetness of glue lines in a freshly combined web of corrugated paperboard is monitored by an apparatus and process incorporating the principles set forth above. Corrugated paperboard is formed generally by bonding a web of liner board to each side of a web of corrugated medium by a water-miscible adhesive, such as a solution of starch. Heat is then applied to gel and dry the starch adhesive.

As the freshly combined corrugated paperboard is dried, it is drawn past a test gap formed by two juxtaposed, spaced apart transmitting elements. A radio frequency signal generated by any suitable means is applied across the two transmitting elements, setting up a strong, but compact, electromagnetic field adjacent to the test gap. As the web of corrugated paperboard passes through this field, fluctuations in the amplitude of the signal appearing across the transmitting elements are monitored, thereby providing an indication of the moisture gradient of the web or, more particularly, of the moisture content of the glue lines.

In those applications where the web being sensed is moving slowly, such as 2 f.p.m., it is possible to monitor fluctuations in the envelope of the amplitude modulated signal appearing across the transmitting elements by using an envelope detector and a conventional voltmeter or ammeter. This arrangement is not satisfactory, however, in applications wherein the web is moving as fast as 500 f.p.m. With such a fast moving web, the conventional ammeter or voltmeter would provide only a reading of average moisture and would not provide an accurate indication of the moisture gradient. For this reason, a peak to peak detector in combination with two operational amplifiers is utilized to convert the varying output of the envelope detector into a substantially constant DC control signal the magnitude of which is indicative of the variations between the moisture of the glue lines and the dry paperboard therebetween. Moisture gradient, as used in this specifications, is an index of the free water in a starch adhesive. This index will vary depending upon the amount of adhesive applied and the chemical and physical characteristics of the starch adhesive after it has been affected by the heat applied.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE INVENTION

Figure 5:
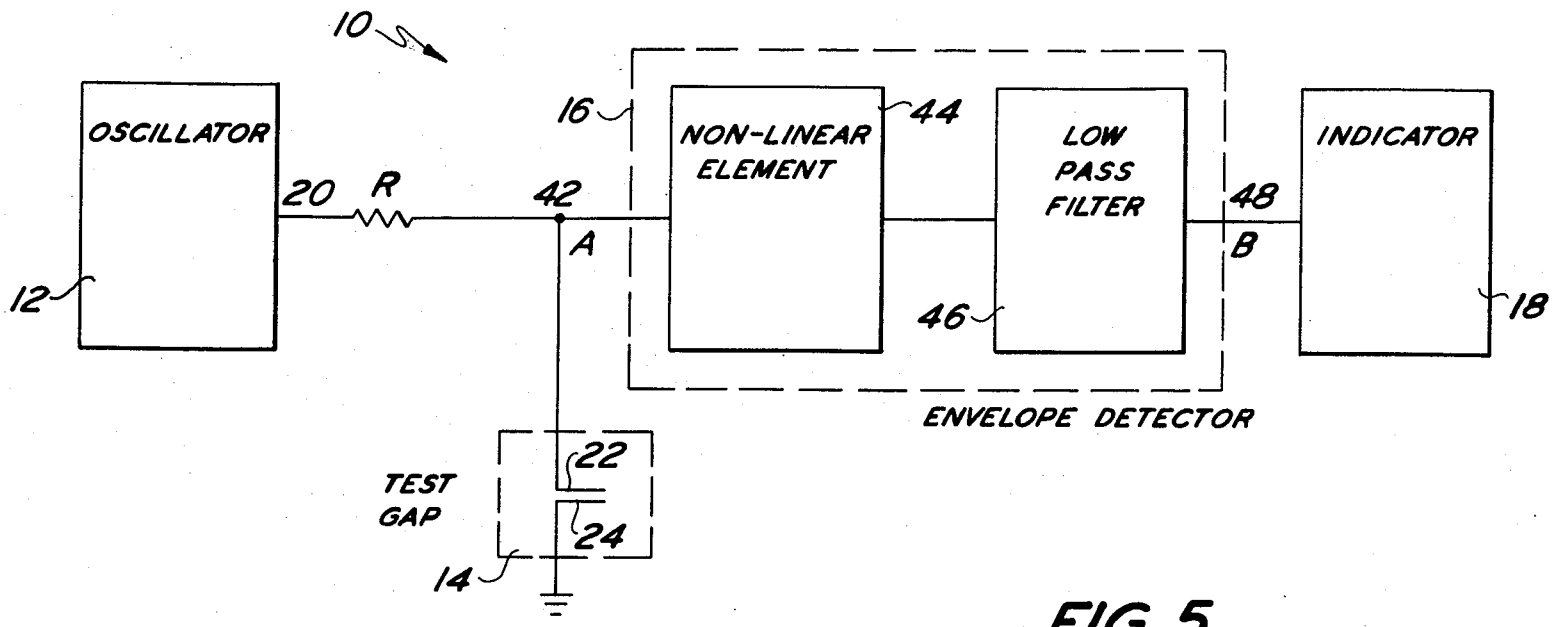
FIG. 5 is a block diagram of a moisture detecting circuit constructed in accordance with the principles of the present invention.

Referring now to the drawings wherein like numerals indicate like elements, there is shown in FIG. 5 a block diagram of a moisture detecting circuit constructed in accordance with the principles of the herein disclosed invention and designated generally as 10. Moisture detecting circuit 10 comprises oscillator 12, test gap 14, envelope detector 16 and indicator 18.

Oscillator 12 generates a radio frequency signal having a predictable frequency and magnitude at its output terminal 20. The radio frequency signal generated by oscillator 12 is applied across test gap 14 through resistor R. Test gap 14 comprises a pair of spaced transmitting elements 22, 24 which transmit the radio frequency signal generated by oscillator 12. By passing a web of material whose moisture gradient is to be sensed through the field generated by transmitting elements 22, 24, it is possible to sense the moisture gradient of the web. Stated otherwise, it is possible to sense the relative moisture content of zones containing varying amounts of moisture such as glue lines, ink lines, or glue film having zones of varying moisture content.

Figure 2:
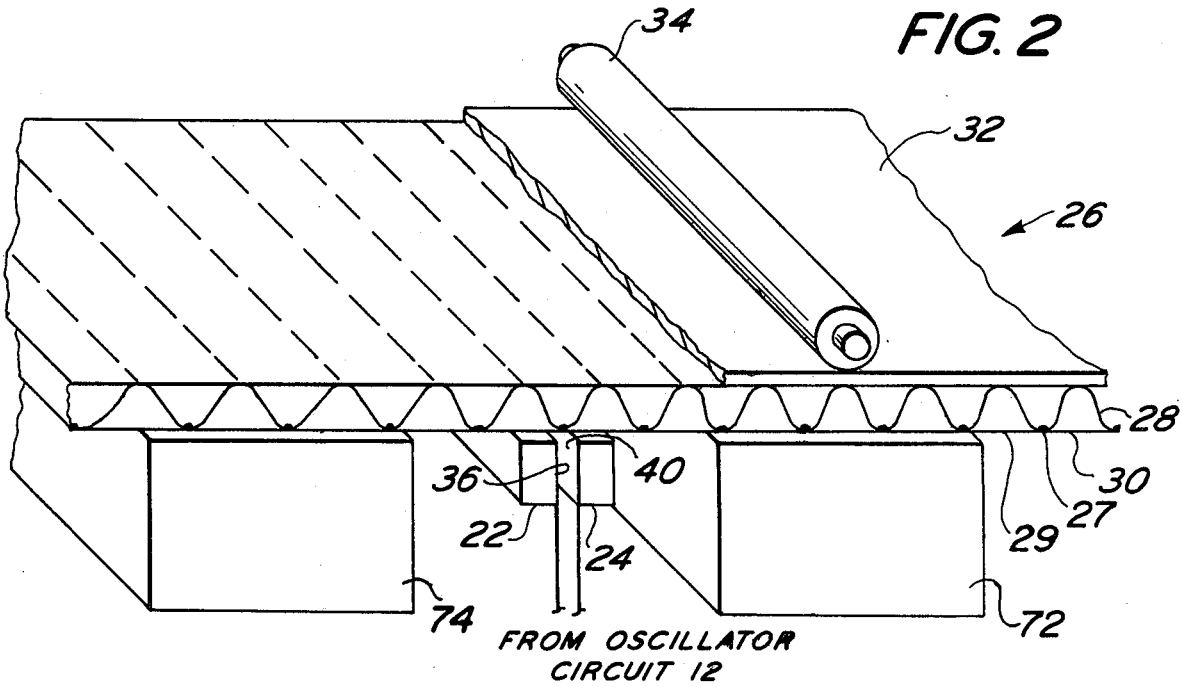
FIG. 2 is a perspective view of the preferred application of the present invention.

The preferred configuration of transmitting elements 22, 24 is illustrated in FIG. 2 which also depicts the preferred application of the present invention. In the preferred application, moisture detecting circuit 10 is utilized to detect the relative moisture content of the glue lines 27 in a newly combined web of corrugated paperboard 26. One such glue line exists wherever the crests of flutes of the corrugated medium 28 are in contact with a liner 30. The web of freshly formed corrugated paperboard 26 is drawn across transmitting elements 22, 24 by endless belt 32 and is biased downwardly by roller 34, which is representative of a plurality of such rollers. Preferably, the transmitting elements 22, 24 comprise two juxtaposed, parallel plates arranged so that inner surfaces 36, 38 are separated by a gap 40. A pair of transmitting elements so constructed provides a strong, well-defined field in the area surrounding gap 40. This field is strongest at the midpoint of gap 40 and dissipates as the distance from test gap 14 increases. By adjusting the spacing between transmitting elements 22 and 24, the extent of the field may be adjusted to meet the resolution requirements of any particular application.

In the preferred application depicted in FIG. 2, the moisture content of the glue lines 27 rather than the dry portions 29 therebetween is of primary interest. For this reason, the resolution of the detector must be approximately equal to one glue line width. By spacing transmitting elements 22, 24 approximately one glue line width apart, the desired resolution is obtained. A glue line has a width of about 1/16 inch.

In order to detect the moisture gradient of the web of corrugated paperboard 26, the web 26 must pass through the field generated by transmitting elements 22, 24. Since the field generated dissipates quickly as the distance from opening 40 increases, web 26 is passed approximately one glue line width from the transmitting elements 22, 24. While the spacing between transmitting elements 22, 24 and web 26 is dependent upon a particular application of the present invention, web 26 must always pass through a sufficiently strong portion of the electromagnetic field to cause detectable energy losses across the transmitting elements 22, 24 owing to the losses associated with the moisture in the glue lines in web 26.

In the preferred embodiment, the width of transmitting elements 22, 24 is approximately ¼ inch and the spacing of gap 40 is approximately 1/16 of an inch. The depth of transmitting elements 22, 24 in the direction perpendicular to the direction of movement of web 26 is approximately two inches. Each transmitting element 22, 24 is constructed of a thin sheet metal approximately 0.01 inches thick. This metal may be any electrical conductor.

While the preferred configuration of transmitting elements 22, 24 has been described as a pair of juxtaposed, parallel plates, it should be recognized that other combinations could be utilized as long as the field generated thereby is sufficiently well-defined to meet the resolution requirements of the particular application.

Referring again to FIG. 5, as web 26 passes through the electromagnetic field adjacent to transmitting elements 22, 24 a radio frequency amplitude modulated signal "A" appears at junction 42. The envelope of amplitude modulated signal A is representative of fluctuations in the electromagnetic energy in the transmitted field and is therefore representative of the moisture gradient in web 26. By passing amplitude modulated signal A through envelope detector 16 and monitoring the output of the envelope detector, an indication of the moisture gradient of web 26 is provided.

Envelope detector 16 is a conventional envelope detector comprising non-linear element 44 and low pass filter 46. Such envelope detectors are well-known in the art and need not be described in detail. An informative review of various types of envelope detectors (as well as the various types of non-linear elements which may be used therewith) may be found in G. Angerbauer, *Electronics for Modern Communications*, N. J. Prentice-Hall, Inc., 1974, p. 471–480. Generally speaking, envelope detector 16 detects the radio frequency amplitude modulated signal A appearing at junction 42 and passes a low frequency signal B at its output terminal 48. Low frequency signal B is indicative of the envelope of the amplitude modulated signal A appearing at the input of envelope detector 16.

In the embodiment illustrated in FIG. 5, low frequency signal B appearing at output terminal 48 of envelope detector 16 is applied to an indicator 18 which provides an indication of the fluctuation in low frequency signal B and therefore in the moisture gradient of web 26.

Figure 1:
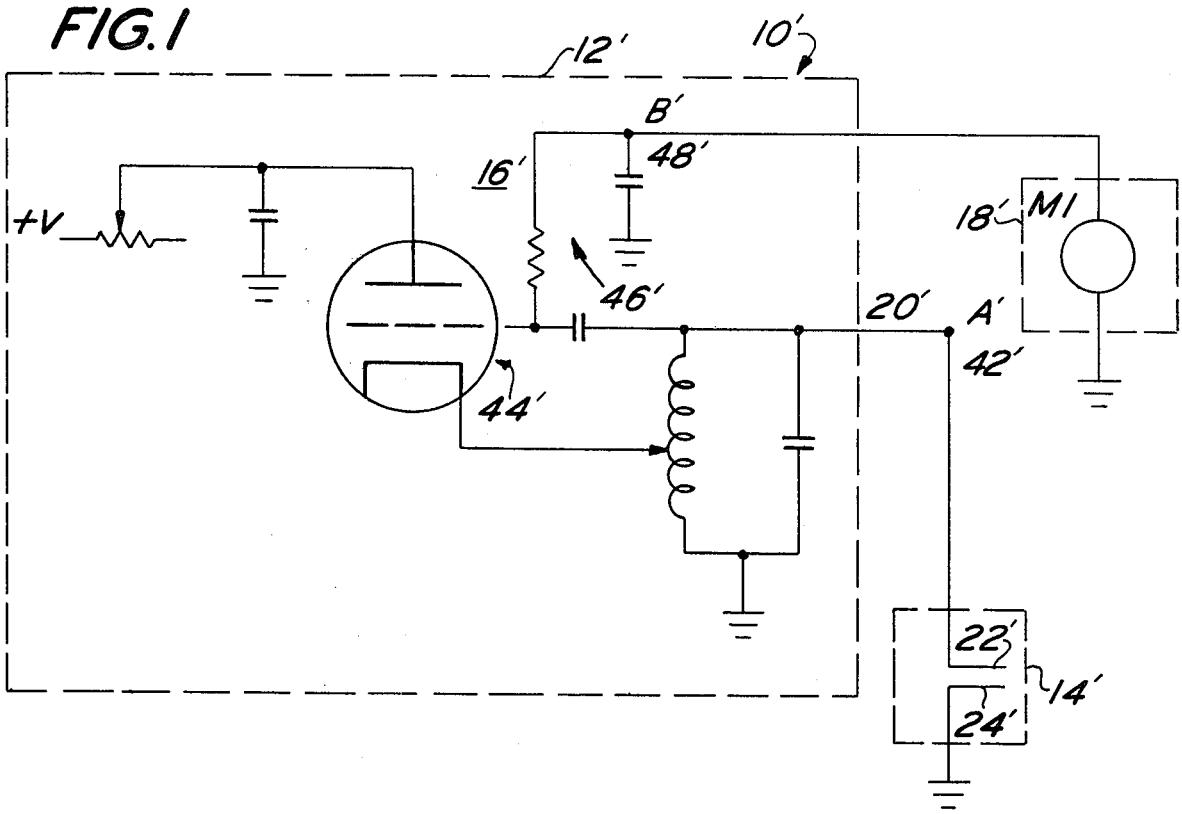
FIG. 1 is a schematic view of a moisture detecting circuit constructed in accordance with the principles of the present invention.

Referring to FIG. 1 there is shown a moisture detecting circuit 10′ constructed in accordance with the principles of the herein disclosed invention. As illustrated herein, oscillator 12′ is a conventional Hartly oscillator which generates a radio frequency signal at its output terminal 20′. The radio frequency signal generated by oscillator 12′ is applied to test gap 14′ which comprises a pair of spaced transmitting elements 22′, 24′. Transmitting elements 22′, 24′ are, in the preferred embodiment, identical to transmitting elements 22, 24 illustrated in FIG. 2. As web 26 passes through the electromagnetic field adjacent to transmitting elements 22′, 24′, an amplitude modulated signal A indicative of the energy losses in the electromagnetic field through which web 26 is passed appears at junction 42′.

Amplitude modulated signal A is applied to envelope detector 16′ comprising non-linear element 44′ and low pass filter 46′. Non-linear element 44′ is the grid of a vacuum tube triode which rectifies the amplitude modulated signal A generating a complex signal including a low frequency component which is indicative of the envelope of amplitude modulated signal A. This complex signal is applied to low pass filter 46′ which passes only the low frequency component of the complex signal. The resultant low frequency signal B is then applied to indicator 18′. Indicator 18′ comprises an ammeter which provides a visual indication of the fluctuations in amplitude modulated signal A and therefore provides an indication of the moisture gradient of web 26.

While sensing circuit 16′ is suitable for static or slow moving webs, it has serious disadvantages when used to measure rapidly moving webs. With rapidly moving webs the resolution of moisture detecting circuit 10′ is inadequate for most applications. Particularly, the meter Ml will indicate the average moisture content of both the glue lines and the linear 30 thereby monitoring bulk moisture rather than a moisture gradient. Additionally, the signals will be affected by glue line width, flute spacing, the amount of glue, liner moisture and other parameters which complicate the monitoring procedure, making difficult the accurate detection of the wetness of the discrete glue lines.

Figure 3:
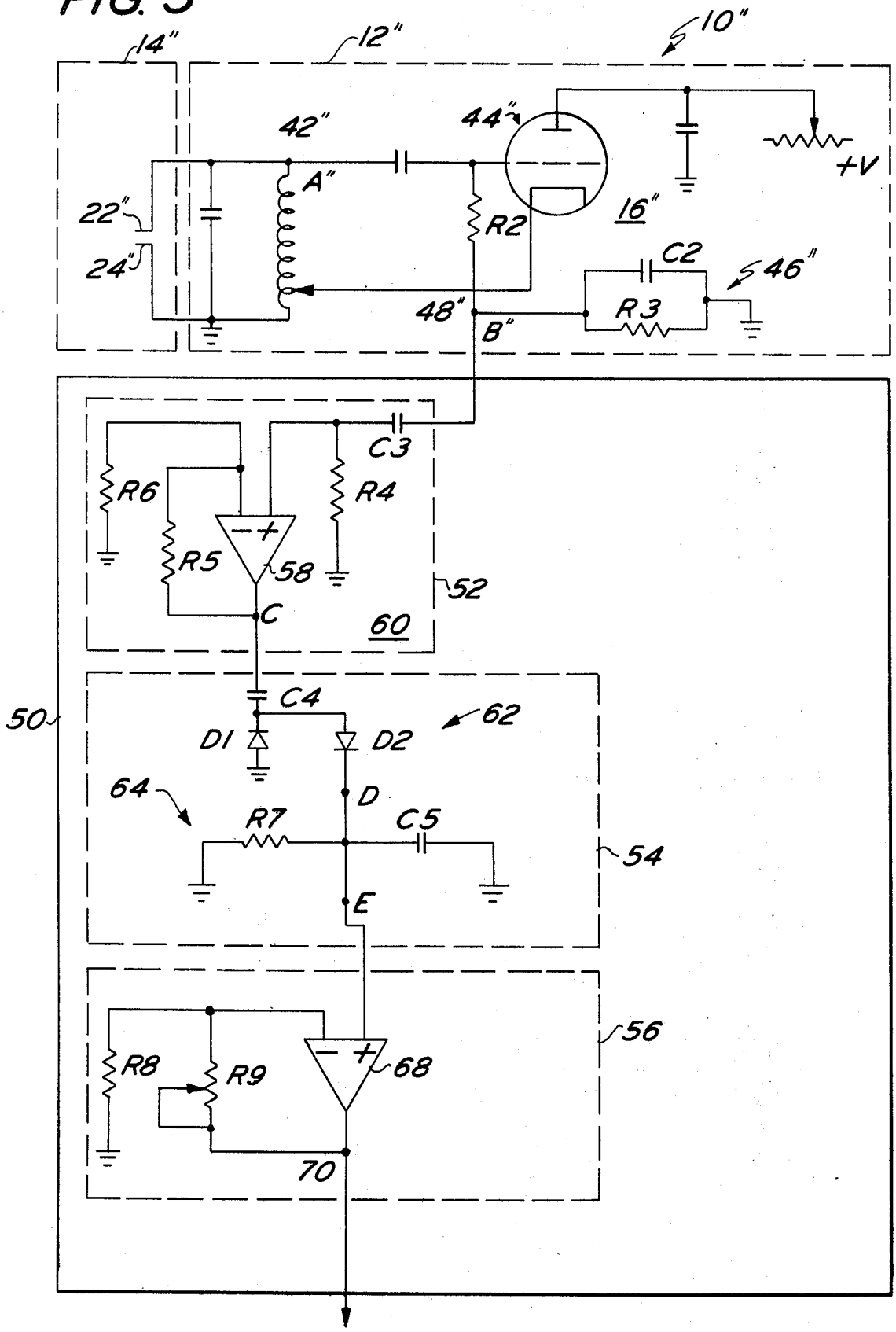
FIG. 3 is a schematic view of a second embodiment to the present invention.

The above-identified limitation may be overcome by employing a peak detector circuit 50 which utilizes a peak reading AC meter to avoid the averaging effects of a fast moving web. One such moisture detecting circuit 10″ is illustrated in FIG. 3. An oscillator 12″ generates a radio frequency signal which is applied across test gap 14″. The structure of oscillator circuit 12″ and test gap 14″ is identical to the structure of oscillator circuit 12′ and test gap 14′, respectively. As with the embodiment illustrated in FIG. 1, a moving web 26 is passed through the electromagnetic field generated by transmitting elements 22″, 24″, causing an amplitude modulated signal A to appear at junction 42″. The envelope of amplitude modulated signal A is indicative of the energy losses in the electromagnetic field through which web 26 is passed. Amplitude modulated signal A is applied to envelope detector 16″ which passes low frequency signal B which is indicative of the envelope of amplitude modulated signal A.

In order to avoid the averaging effects of fast moving web 26, low frequency signal B is applied to peak detector circuit 50. Peak detector circuit 50 comprises AC amplifier circuit 52, peak to peak detector 54 and DC amplifier circuit 56. Low frequency signal B is applied to the non-inverting input terminal of operational amplifier 58 via differentiator circuit 60. Operational amplifier 58 is a standard operational amplifier connected to operate as a difference amplifier. Since the inverting input terminal of operational amplifier 58 is connected through resistor R6 to ground, its output will be an amplified replica of low frequency signal B appearing at junction 48''.

The output signal generated by operational amplifier 58 is applied to peak to peak detector circuit 54. Peak to peak detector circuit 54 comprises rectifier circuit 62 and RC circuit 64. While the rectifier circuit 62 illustrated in FIG. 3 is a peak to peak rectifier which passes a rectified waveform having a magnitude which is twice that of the output signal generated by operational amplifier 58, a simple rectifier circuit which does not double the amplitude of the rectified signal may also be employed. RC circuit 64 is a simple RC circuit having a time constant which is relatively long with respect to the frequency of low frequency signal B appearing at junction 48''. As such, RC circuit 64 passes an almost constant magnitude linear DC waveform which conforms to the peaks of the rectified signal passed by rectifier circuit 62. The magnitude of this DC waveform will be proportional to the moisture variation between the glue lines and the dry liner 30 of the freshly formed web of corrugated paperboard 26 illustrated in FIG. 2.

The output of peak detector circuit 54 is applied to the non-inverting input terminal of operational amplifier 68 of DC amplifier circuit 56. Operational amplifier 68 is a standard operational amplifier which is connected to operate as a difference amplifier. Since its inverting input terminal is connected to ground through resistor R8, its output will be an amplified replica of the linear DC waveform applied to its input. A variable resistor R9 has been included in the feedback loop of operational amplifier 68 in order to provide an adjustment for the amplification factor thereof.

The output of DC amplifier circuit 56 at junction 70 may be applied to an indicator circuit (not shown) similar to indicator circuit 18 in FIG. 5. The output of DC amplifier circuit 56 may also be utilized as a control signal for an appropriate control apparatus. With particular reference to the preferred application illustrated in FIG. 2, the output of DC amplifier circuit 56 may be applied to a controller regulating the amount of heat generated by heating elements 72, 74 in accordance with the amount of moisture present in the glue lines.

The preferred values of the components of circuit 10'' are given in the following Table.

TABLE 1

| Resistors | | Capacitors | | Integrated Circuits |
|---|---|---|---|---|
| R2 | 25K | C2 | .005μf | Op. Amp 48 AD201AL |
| R3 | 25K | C3 | 1μf | Op. Amp 54 AD201AL |
| R4 | 100K | C4 | 1μf | |
| R5 | 10Meg | C5 | 1μf | |
| R6 | 100K | | | |
| R7 | 100K | | | |
| R8 | 100K | | | |
| R9 | 10Meg | | | |

To better understand the operation of moisture detecting circuit 10'', its operation will be described with reference to the preferred application illustrated in FIG. 2. As the freshly combined corrugated paperboard web 26 passes over test gap 14'', the electromagnetic field generated by transmitting elements 22'', 24'' will alternately detect a wet glue line 27 or the dry portion 29 of liner 30. If a wet glue line passes over gap 40 in the test gap 14'', it absorbs energy from the electromagnetic field surrounding test gap 14'', and reduces the magnitude of amplitude modulated radio frequency signal A appearing at junction 42''. This signal is illustrated in graph A of FIG. 4.

Figure 4:
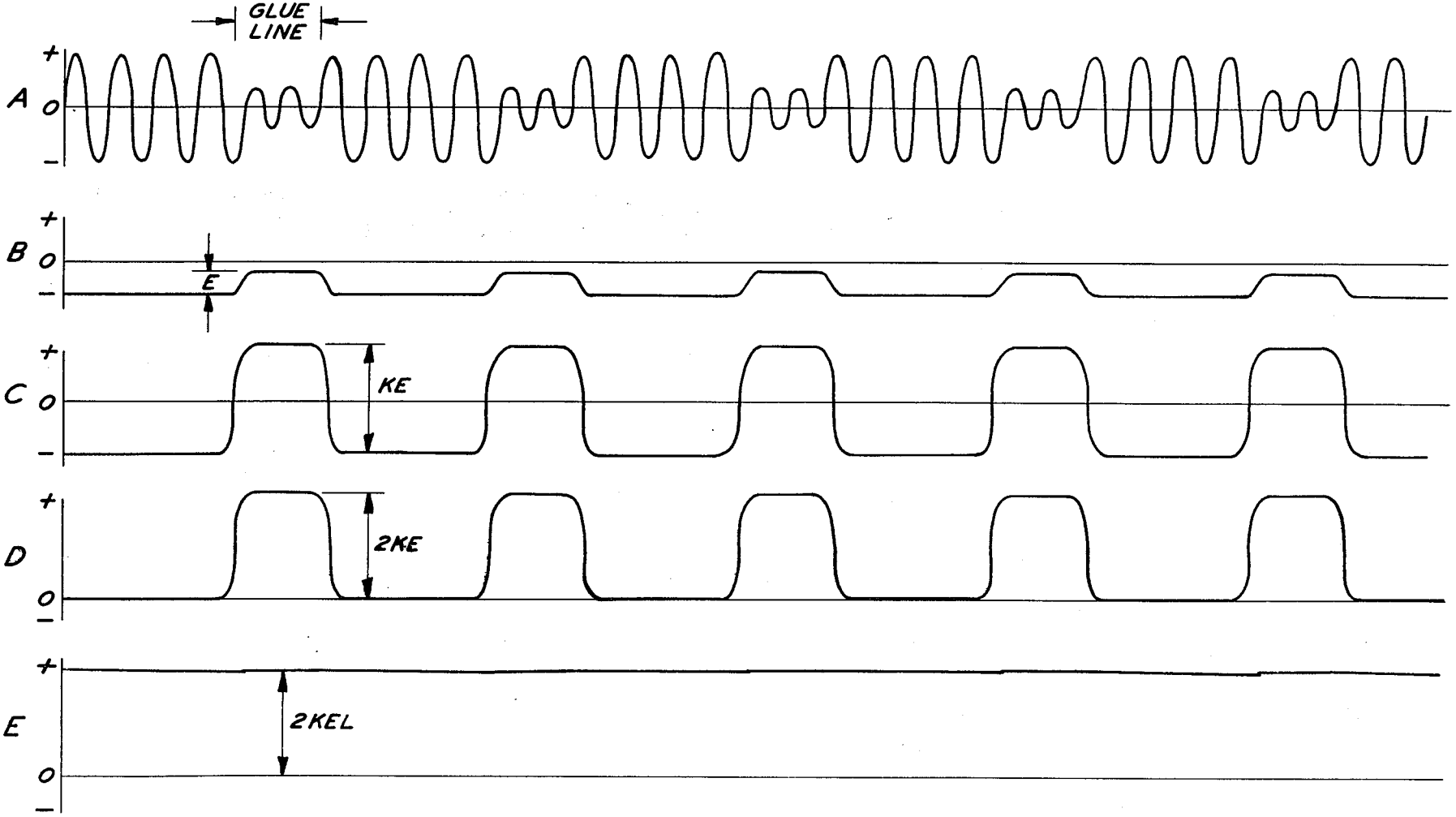
FIG. 4 is a plurality of graphs illustrating the waveforms of the signals appearing in various junctions of the circuit illustrated in FIG. 3.

It will be recognized by those skilled in the art that the waveforms shown in graph A as well as those shown in graphs B through E in FIG. 4 are merely representative of actual waveforms. It should be further recognized that each cycle of the amplitude modulated waveform illustrated in graph A is representative of several hundred or even several thousand cycles of amplitude modulated signal A appearing at junction 42''. Additionally, frequency variations due to changes in the dielectric constant of web 26 have been ignored since they are inconsequential to the operation of moisture detecting circuit 10''.

The amplitude modulated radio frequency signal A appearing at junction 42'' is applied to non-linear element 16'' which passes only low frequency signal B which is indicative of the envelope of amplitude modulated radio frequency signal A. The waveform of low frequency signal B is illustrated in graph B of FIG. 4.

Low frequency signal B is then applied to AC amplifier circuit 52 which generates an amplified replica of low frequency signal B. The output of AC amplifier circuit 52 is illustrated in graph C wherein K is the amplification factor of operational amplifier 58.

The output of AC amplifier circuit 52 is applied to the rectifier circuit 62 of peak to peak detector circuit 54. Whenever the output of AC amplifier circuit 52 is negative, diode D2 is reverse biased and capacitor C4 is charged through diode D1 and ground. As the output of AC amplifier circuit 52 becomes positive, diode D1 is reverse biased and diode D2 is forward biased. This permits capacitor C4 to discharge through diode D2 thereby doubling the amplitude of the rectified signal appearing at the cathode of diode D2. The waveform of the signal is illustrated in graph D of FIG. 4.

The rectified waveform appearing at the cathode of diode D2 is applied to RC circuit 64 which holds the peak voltage of this waveform thereby presenting an almost constant linear DC waveform to the non-inverting input of operational amplifier 68. This waveform is illustrated in graph E of FIG. 4. The linear DC waveform shown in graph E of FIG. 4 is amplified by DC amplifier circuit 56 by an amount determined by variable resistor R9. The output of DC amplifier circuit 56 is, therefore, an amplified replica of graph E.

Since the linear DC output of DC amplifier circuit 56 conforms to the peak value of amplitude modulated ratio frequency signal A appearing at junction 42'', its magnitude is representative of variations in the moisture content between the glue lines 27 and dry portion 29 of the freshly formed web of corrugated paperboard 26 passing through the transmitted ratio frequency signal. Particularly, the wetter the glue lines with respect to the dry portion 29, the greater the amplitude of the DC output signal of peak detector circuit 50. This DC output or control signal may therefore be used to drive either a meter or a controller as indicated above.

The present invention may be embodied in other specific forms without departing from the spirit or essential attributes thereof and, accordingly, reference should be made to the appended claims, rather than to the foregoing specification as indicating the scope of the invention.

What is claimed is:

1. Apparatus for generating a control signal representative of the moisture gradient in a moving web of material containing various amounts of moisture, comprising:

means for generating a radio frequency signal;

means for transmitting said radio frequency signal as an electromagnetic field;

means for applying said radio fequency signal to said transmitting means; and envelope detector means for generating a low frequency signal repesentative of the envelope of an amplitude modulated radio frequency signal appearing across the transmitting elements, the envelope of said amplitude modulated signal being representative of fluctuations in the strength of said electromagnetic field due to the absorption of energy by moisture in a web moved through said field.

2. Apparatus in accordance with claim 1 wherein said transmitting means comprises a pair of transmitting elements, said transmitting elements being juxtaposed and spaced apart to define a gap therebetween.

3. Apparatus in accordance with claim 2 including indicator means responsive to said low frequency signal for providing an indication of the moisture gradient of the web moved through said field.

4. Apparatus for generating a control signal representative of variations between the moisture content of glue lines and dry paperboard between glue lines in a freshly formed web of corrugated paperboard, comprising:

means for generating a radio frequency signal;

a pair of transmitting elements;

means for applying said radio frequency signal to said transmitting elements whereby said transmitting elements transmits said radio frequency signal as an electromagnetic field; and envelope detector means for generating a low frequency signal representative of the envelope of an amplitude modulated radio frequency signal appearing across said transmitting elements, the envelope of said amplitude modulated signal being representative of fluctuations in the strength of said electromagnetic field owing to the absorption of energy by moisture in a web moved through said field.

5. Apparatus in accordance with claim 4, wherein said transmitting elements comprise a pair of juxtaposed and spaced apart plates.

6. Apparatus in accordance with claim 4, including indicator means responsive to said low frequency signal for providing an indication of variations between the moisture content of glue lines and dry paperboard between glue lines in a freshly formed web of corrugated paperboard.

7. A process for sensing the relative moisture content of zones in a moisture containing medium comprising the steps of:

generating a radio frequency signal;

transmitting said radio frequency signal as an electromagnetic field; and applying an amplitude modulated radio frequency signal appearing across said transmitting elements to an envelope detector means thereby generating a low frequency signal representative of the envelope of said amplitude modulated radio frequency signal, the envelope of said amplitude modulated radio frequency signal being representative of fluctuations in the strength of said electromagnetic field due to the absorption of energy by moisture in said zones in a moisture containing medium moved through said field.

8. A process in accordance with claim 7, wherein the step of transmitting said radio frequency signal as an electromagnetic field comprises the step of applying said generated radio frequency signal to a pair of spaced transmitting elements.

9. Apparatus in accordance with claim 1 including peak detector means responsive to said low frequency signal for generating a DC signal whose magnitude is representative of the peak values of said low frequency signal.

10. Apparatus in accordance with claim 9 wherein said peak detector means comprises:

an AC amplifier means for amplifying said low frequency signal;

second peak detector means responsive to said amplified low frequency signal for generating a DC signal whose magnitude is representative of the peak value of said amplified low frequency signal; and DC amplifier means for amplifying the DC output signal of said second peak detector means, the output of said DC amplifier means being said control signal.

11. Apparatus in accordance with claim 4 including peak detector means responsive to said low frequency signal for generating a DC signal whose magnitude is representative of the peak values of said low frequency signal.

12. Apparatus in accordance with claim 11, wherein said peak detector means comprises:

AC amplifier means for amplifying said low frequency signal;

second peak detector means responsive to said amplified low frequency signal for generating a DC signal whose magnitude is representative of the peak value of said amplified low frequency signal; and DC amplifier means for amplifying the DC output signal of said second peak detector means, the output of said DC amplifier means being said control signal.

13. A process in accordance with claim 7 including the step of generating a DC signal whose magnitude is representative of the peak values of said low frequency signal.

14. A process in accordance with claim 13, wherein said step of generating a DC signal whose magnitude is representative of the peak value of said low frequency signal comprises the steps of:

amplifying said low frequency signal;

generating a DC signal whose magnitude is representative of the peak value of said amplified low frequency signal; and amplifying said DC signal whose magnitude is representative of the peak value of said amplified low frequency signal.

15. A process in accordance with claim 7, including the step of using said low frequency signal for controlling the amount of heat applied to said moisture containing medium.

* * * * *